United States Patent [19]

Zofko

[11] 4,037,550

[45] July 26, 1977

[54] DOUBLE SEAMED CONTAINER AND METHOD

[75] Inventor: David Edward Zofko, Greenwich, Conn.

[73] Assignee: American Can Company, Greenwich, Conn.

[21] Appl. No.: 687,496

[22] Filed: May 18, 1976

Related U.S. Application Data

[62] Division of Ser. No. 483,800, June 27, 1974, abandoned.

[51] Int. Cl.[2] ..... B21D 51/32; B21D 51/34

[52] U.S. Cl. ..... 113/120 Y

[58] Field of Search ..... 113/1 E, 12, 19, 23 R, 113/30, 120 Y, 120 K; 220/67

[56] References Cited

U.S. PATENT DOCUMENTS

| | | | |
|---|---|---|---|
| 2,250,002 | 7/1941 | Bogner | 113/19 |
| 3,402,591 | 9/1968 | Maeder | 113/120 H |
| 3,603,275 | 9/1971 | Eickenhorst | 113/120 H |
| 3,774,560 | 11/1973 | Hartz | 113/120 Y |
| 3,952,677 | 4/1976 | Hartman et al. | 113/120 Y |

FOREIGN PATENT DOCUMENTS

| | | | |
|---|---|---|---|
| 100,684 | 1/1941 | Sweden | 220/67 |
| 404,532 | 12/1965 | Switzerland | 220/67 |

*Primary Examiner*—Michael J. Keenan

*Attorney, Agent, or Firm*—Robert P. Auber; Paul R. Audet; George P. Ziehmer

[57] ABSTRACT

A method of hermetically pressure-resistantly double seaming a metal end closure to a metallic container body whose wall is highly-worked, has a substantially axial grain direction and is less than about 0.057 inch thick at its marginal end portion, which includes forming a body curl of the marginal end portion and double seaming the end closure thereto, and, the resulting double seamed metallic container whose double seam includes six substantially axial metallic layers, two of which are a radially compressed body curl.

7 Claims, 9 Drawing Figures

PRIOR ART

DOUBLE SEAMED CONTAINER AND METHOD

This Application is a Division of abandoned Application Ser. No. 483,800, filed June 27, 1974, now abandoned.

BACKGROUND OF THE INVENTION

This invention relates to metallic containers and has particular reference to hermetically double seaming metal end closures to very thin-walled metallic can bodies, for example those used for packaging beer and carbonated beverages, and the like.

The conventional method of attaching metal end closures to open-ended metallic container bodies includes, flanging the marginal end portion of the can body, and double seaming the body flange with the closure flange by rolling or tucking the closure flange under the body flange to form five metal layers in the seam area, and the pressing or ironing the five layers tightly together against the container body wall.

Heretofore, hermetic, pressure-resistant double seams between metal end closures and very thin-walled metallic container bodies were very difficult to obtain and were seldom obtained. The main reason was that forming conventional double seams required forming a 0.090 to 0.100 inch conventional flange of the marginal end portions of the container body walls. While this presents no problem in relation to container walls of conventional thickness, that is, greater than about 0.008 inch adjacent the open ends of the container bodies, it was found that certain very thin, highly-worked metal body walls having a substantially vertical or axial grain direction and whose thickness adjacent their marginal open end portions was less than about 0.006 inch for three-piece containers and less than about 0.0057 for two-piece containers could not be flanged and hence could not readily be double seamed. The problem is that the metal of such highly-worked highly-directional body walls often will not elongate to the extent required for forming a flange. The wall metal at the marginal end portions is too thin, and too brittle, and elongation during flanging is in the same grain direction as in the drawing and ironing process. This inability to elongate as required produces cracks in the flanges and such flanges often preclude obtaining hermetic pressure-resistant double seams.

Heretofore, can manufacturers have sought to overcome flange cracking and resulting inhermetic seams by neckingin or providing extra metal in certain end regions of can body walls for example drawn and ironed containers by beefing up the thickness of the metal in the area to be flanged about 0.002 inch or more and by using sealant materials in the double seams. But neither remedy prevents cracks in flanges and each is costly and brings on its own problems. For example, providing extra metal at end regions of drawn and ironed container bodies makes it difficult to strip them from their drawing punches.

Even if uncracked flanges satisfactory for double seaming could be obtained in these very thin highly-worked container bodies, the edges would be excessively sharp and cause damage to compound linings required on the interior surfaces of end closure flanges, and to sealing rubber gaskets of can testing and can filling machines. Also, flanged very thin highly-worked metal container bodies are usually weak at their upper regions and are highly susceptible to denting, crushing and other abuse during storage and handling.

It has now been found that by employing a body curl instead of a flange, the aforementioned flange-related problems are greatly reduced and unexpectedly hermetic double seams resistant to product internal pressures can be obtained. Body curls have been found to require less metal elongation than conventional flanges. Whereas the latter requires 7 to 8% elongation, the former requires less than about 4% elongation. Because of this, body curls formed of extremely thin highly-worked metal containers rarely have cracks or puckers.

Double seaming curled rather than flanged container body walls saves metal because end closure flanges can be shorter than conventional ones.

In view of the above shortcomings of flanging and the above and other advantages of curling the marginal end portions of very thin highly-worked metal container bodies, it is an object of this invention to provide a very thin, highly-worked metallic cylindrical container that has a metal end closure hermetically, and pressure resistantly double seamed thereto.

Another object of this invention is to provide double seamed cylindrical containers of the aforementioned type wherein the container body wall metal has a substantially axial grain direction and its thickness is less than 0.006 inch at its marginal end portion for three-piece and less than about 0.0057 inch for two-piece containers.

Another object of this invention is to provide the aforementioned double seamed containers wherein before double seaming their marginal end portions were in the form of body curls.

Another object of this invention is to provide the aforementioned double seamed containers wherein the metal layers of the double seam include a radially compressed body curl.

Another object of this invention is to provide a method of hermetically double seaming a metal end closure to a very thin walled container body.

It is another object of this invention to provide the aforementioned method wherein the container body wall metal has a substantially axial grain direction and its thickness at its marginal open end portion is less than about 0.006 inch for three-piece and less than about 0.0057 inch for two-piece container bodies.

Numerous advantages and objects of this invention will be apparent as it is better understood from the following description, which, taken in conjunction with the drawings, discloses preferred embodiments thereof.

DETAILED DESCRIPTION OF THE INVENTION

Figure 1:
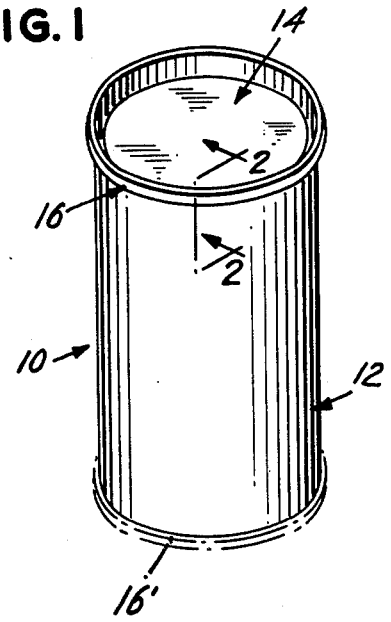
FIG. 1 is a perspective view of the hermetically double seamed metallic container of this invention.

FIG. 1 is a perspective view of a highly-worked thin-walled metallic container generally designated 10 comprising a container body generally designated 12 having a metallic container end closure generally designated 14 attached thereto by means of a hermetic pressure resistant double seam generally designated 16. Container 10 can be a two-piece drawn and ironed aluminum or steel container, whose body wall metal thickness at its marginal end portion is less than about 0.0057 inch, preferably about 0.0048 inch for the former, and about 0.0038 inch for the latter, or it can be a three-piece container, usually steel, whose body wall metal thickness at its marginal end portion or portions is less than about 0.006 inch. The steel used as the metal for the two-piece container bodies is usually over 100 lb. plate, and the steel used as the metal for the three-piece container bodies is usually a double-cold-reduced tin free steel, electrolytic tinplate, or black plate steel, usually about 55 lb. plate. The two-piece container 10 has an integral bottom wall (not shown). When container 10 is a three-piece container it has a separate bottom wall (not shown) secured thereto by a double seam 16' (dashed line) of this invention. The body wall metal grain direction of the aforementioned two- and three-piece containers is substantially vertical or axial. Container 10 is of the type used for packaging products such as beer and carbonated beverages and the like because its body wall metal and double seam 16 or 16' are capable of holding internal pressures of up to about 90 psi developed at elevated temperatures of up to about 140° F.

Figure 2:
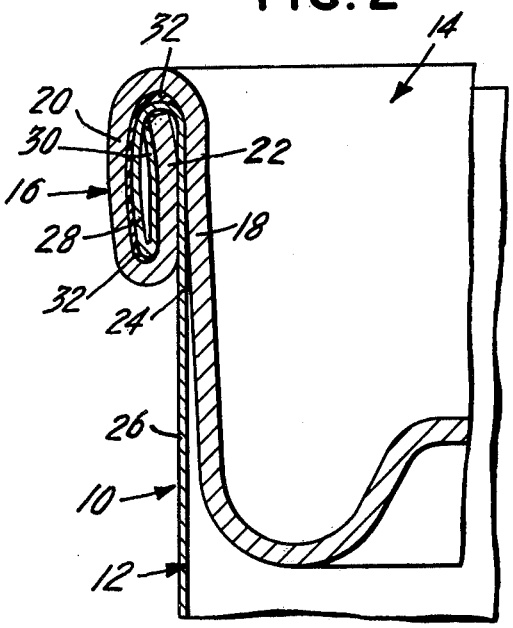
FIG. 2 is an enlarged cross section taken substantially along line 2—2 of FIG. 1.

FIG. 2 is an enlarged cross section showing double seam 16 of FIG. 1 in detail. More particularly, FIG. 2 shows that double seam 16 comprises 6 metallic layers including substantially vertical closure countersink wall 18, downwardly depending cover skirt 20, cover hook 22, marginal end portion 24 of body wall 26, body skirt 28 and body hook 30. Included within double seam 16 is a conventional sealant material 32 which helps render the double seam hermetic and pressure resistant. FIG. 2 also shows that countersink wall 18 is thicker than the body wall marginal end portion 24.

Figure 3:
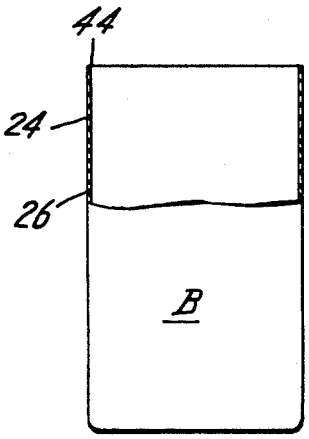
FIGS. 3–5 are side elevations with portions broken away and portions in cross section, showing steps in the method of this invention, FIG. 3, an uncurled cylindrical metallic container body, FIG. 4, after the body has been curled, and FIG. 5 an end closure being applied thereto.

FIG. 3 is a side elevational view with portions broken away of an uncurled substantially cylindrical open-ended container body B having substantially straight body wall 26 that is uncurled at its marginal end portion 24.

Figure 4:
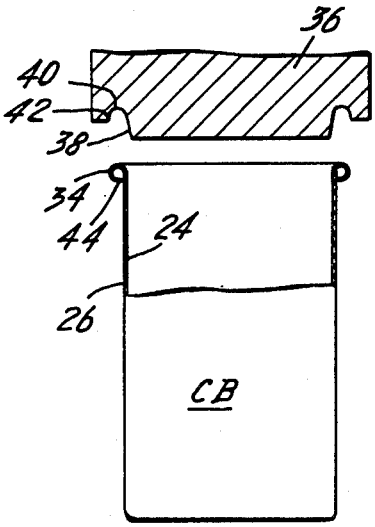

As shown in FIG. 4, in the method of hermetically pressure resistantly double seaming a metallic container end closure to open-ended metallic cylindrical container body B, an annular hollow body curl 34 is formed of the marginal end portion 24 of container body B by a conventional curling means such as a roll or as shown in FIG. 4, a die or chuck 36 having a frustoconical chuck wall 38 which merges into a U-shaped inverted channel 40 which in turn merges into skirt wall 42. Chuck 36 is moved vertically down over marginal end portion 24 of container body B, which supported by any suitable means, so that edge 44 follows the contour of chuck wall 38, channel 40, and skirt 42 and thereby forms body curl 34 whose edge 44 faces or points toward container body wall 26.

Figure 5:
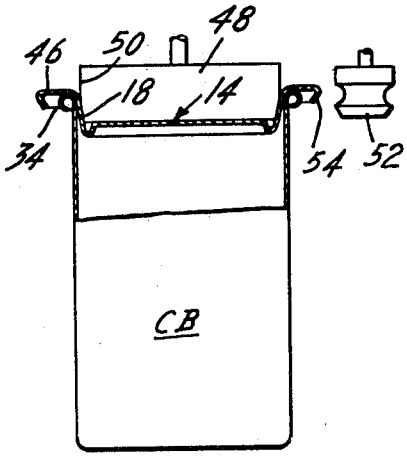

As shown in FIG. 5, a metallic container end closure 14 having a peripheral flange 46 is placed over the open end of curled container body CB of FIG. 4. End closure flange 46 has a flange curl 54 adjacent its outer edge to assist in forming the double seam in a manner to be explained. Some portion of the end closure and/or the container body, for example, the inner surface of end closure flange 46, is coated with sealant material 32 which assists in forming the hermetic double seam. When cover flange 46 is resting on curl 34, chuck 48 is brought vertically down onto end closure 14 so that the chuck peripheral wall 50 provides a rigid supportive backing for forming a double seam with roller 52. When roller 52 is rotating and brought substantially horizontally radially inward toward cover 14, the end portion of end closure flange 46, including flange curl 54, is bent or curled downward and up under the body curl 34 between the curl and the container body so that end flange 46, more particularly, flange curl 54 forms end closure skirt 16 and cover hook 22 (FIG. 2) which thereby forms a relatively loose first operation double seam which then is compressed radially inward by another roller similar to roller 52, or other suitable ironing means to flatten the seam and tighten and bond it against container body CB to hermetically pressure-resistantly double seam container end closure 14 thereto to form double seamed container 10 of FIGS. 1 and 2.

Figure 6:
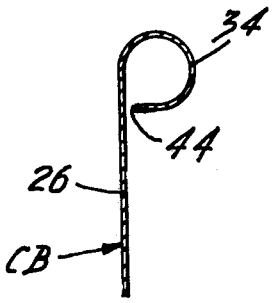
FIG. 6 is a cross sectional view of the marginal end portion of a curled thin-walled container body.
Figure 7:
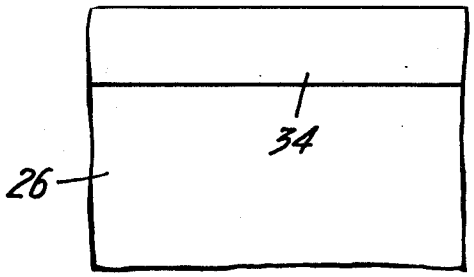
FIG. 7 is a side elevational view of FIG. 6.

FIG. 6 is an enlarged cross section through the top portion of curled container body CB of FIG. 4 and FIG. 7 is a side elevational view of the curl of FIG. 6. More particularly, FIGS. 6 and 7 show that thin-walled container body curl 34 which is interfolded with the end closure flange 46, is smooth, uniform and contiguous.

Figure 8:
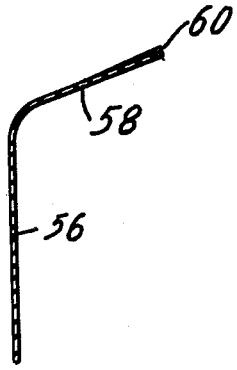
FIG. 8 is a cross sectional view of a portion of a flanged end portion of thin-walled metallic container body.
Figure 9:
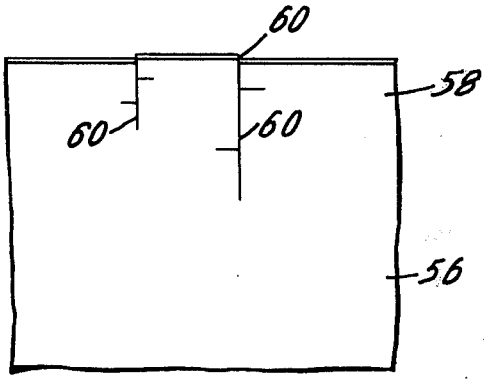
FIG. 9 is a side elevation view of the marginal end portion of the container body wall shown in FIG. 8.

FIG. 8 is an enlarged cross section through the upper portion of a flanged conventional container body 56 and FIG. 9 is a side elevational view of FIG. 8. More particularly, FIGS. 8 and 9 show that the conventional flange 58 of a conventional thin-walled metallic container body 56 has short and long cracks 60 therein, which preclude such flanges from being used to form hermetic pressure resistant double seams.

It is to be noted that with respect to the container body curls used to form the double seams of this invention, a reason for the lack of cracks in the body curls and for their presence thereof in conventional flanges is that the marginal end portions of very thin metallic body walls whose thicknesses are within the scope of this invention have substantially axial grain directions, and are brittle and worked or elongated from about 33 to about 50 percent less when curls rather than flanges are formed. This reduction in elongation occurs whether the very thin metallic material of the body wall is highly-worked drawn and ironed aluminum steel, or whether the material is heated treated and/or coated for example with conventional primers such as acetylacetonates, slip coatings such as modified epoxies, adhesives such as ethylene acrylic acid copolymers, and polyethylenes, or combinations thereof.

The radius of the body curls formed of the marginal end portions of metallic container bodies according to the method of this invention and used to form the double seams of this invention, can be any suitable radius which causes the edge of the body curl to point toward the container body wall and which permits the hermetic pressured-resistant double seams of this invention to be formed. The radius of the curl must be greater than the thickness of the wall metal of which it is formed. It has been found that the range of curl radii which can be suitable varies depending on the body wall material employed. Generally, when the radius is too small, a curl cannot be formed, and when too large, cracking and/or puckering occurs. Generally, acceptable radii for aluminum and steel drawn and ironed containers range from about 0.007 to about 0.035 inch.

As shown in Table below, as compared to conventional flanges, curls require less body material for their formation, their percent of elongation is less than for conventional flanges which require from 7 to 8% elongation, and curls have practically no cracks and puckers therein. Contrastingly, 100 percent of the conventional flanges of 0.090 to 1.0 inch length formed on container bodies tested had cracks therein which rendered them unsuitable for forming hermetic, pressure-resistant double seams.

TABLE

| Container Body Material | Thickness (inches) | Grain Direction | % Elongation Strip (2 inch)* | Curl | Conventional Flange Width (inches) | Preferred Curl Diameter (inches) | Cracks & Puckers in Curls |
|---|---|---|---|---|---|---|---|
| Drawn and Ironed Aluminum | 0.0048 | Vertical | 2.0 | 4.70 | 0.092(±.007) | 0.060 | None |
| Steel | | | | | | | |
| Tinplate | 0.0038 | Vertical | 0.8 | 3.50 | 0.092(±.007) | 0.045 | None |
| Blackplate | 0.0038 | Vertical | 1.0 | 3.50 | 0.092(±.007) | 0.045 | None |

*Each two inch strip was cut from around the marginal end portion of the container body side wall made of the material listed in the first column, whose thickness is listed in the second column.

Each two inch strip was cut from around the marginal end portion of the container body side wall made of the material listed in the first column, whose thickness is listed in the second column.

The double seams of this invention which can be formed according to the method of this invention are formed by applying to a surface of the end closure or container body or both, a sealant material which will be within the double seam, and, double seaming then end closure to the container body by bending the end closure flange downward and up under the body curl between the curl and container body to form a depending end closure skirt and an integral upwardly extending coverhook. This bending action of the closure flange radially compresses the body curl and it forms a first operation double seam which is relatively loose, usually about 0.096 to 0.099 inch wide. This seam is then radially compressed to tighten and bond it against the container body to form hermetic pressure-resistant double seam whose width usually ranges from about 0.067 to 0.069 inch. The radial compressing step radially compresses the body curl between the closure skirt and the coverhook in a manner that conforms the body curl to substantially the shape or contour of the end closure skirt and coverhook.

The double seam comprises six substantially axial metallic layers including end closure countersink wall 18, container body wall marginal end portion 24, end closure coverhook 22, two layers of the radially compressed body curl including body hook 30 and body skirt 28, and closure skirt 20. The body skirt and body hook are formed from the compressed curl, which preferably extends substantially the length of the closure skirt and coverhook. The two substantially axial layers of radially compressed body curl, i.e. body hook 30 and body skirt 28 are adjacent each other and are situated between end closure cover hook 22 and end closure skirt 20. Body hook 30 of the compressed curl has an edge which points upward and preferably is adjacent a portion of the arcuate bend or shoulder between the end closure countersink wall portion and the end closure skirt.

Sealant materials employable in double seams of this invention can be any suitable ones used in conventional double seams such as thermoplastic materials, and compound linings used in double seams of drawn and ironed containers of conventional thickness which are flanged for forming their double seams. Whatever the sealant employed, it must provide a hermetic seam, and be compatible and coordinated with the product packaged within the container and with coating materials usually applied to the surfaces of the metal end closures and container bodies to insulate them from corrosive products. Protective coatings (not shown) often utilized with thermoplastic adhesives on metallic container bodies include vinyl type coatings over modified epoxy type base coatings.

Examples of thermoplastic adhesives which can be employed in the double seams of this invention are heat activatable adhesives based on an ethylene acetate terpolymer, a butadiene-styrene-block copolymer, and a polyamide polymer. Because their shear strength is being relied upon, these adhesives need not be heat activated to be effectively employed in the double seams of this invention.

An ethylene-vinyl-acetate acid terpolymer based adhesive can be produced by mixing 65 parts by weight of an ethylene-vinyl-acetate organic acid terpolymer with 35 parts by weight of a polyterpene resin. This is then dissolved in 200 parts by weight of a heated solvent such as aromatic petroleum hydrocarbon. The solution is cooled into a hard gel which is reheated to about 150° F. when applied to the container components. The coated components are cured at 100° F. to drive off the solvent. The adhesive lined ends or container bodies may then be stored until ready for attachment at which time the adhesive can but need not be reactivated by heating to 300° F. and used to adhesively bond the end closures to the container bodies. The ethylene-vinyl-acetate organic acid terpolymer preferably has a 20% by volume vinyl acetate content with an acid number of six. An example of a preferred ethylene-vinyl-acetate organic acid terpolymer is manufactured by E.I. DuPont de Nemours and Company and sold under the trade designation EP-3656-9.

A butadiene-styrene-block copolymer based adhesive can be produced by mixing 56.71 parts by weight of a styrene-butadiene-block copolymer, having 25% by volume of the styrene molecule and 75% by volume of the butadiene molecule, with 21.22 parts by weight of a polyterpene resin, 21.22 parts by weight of a commarone-indene resin, and 0.85parts by weight of an antioxidant. This is dissolved in 200 parts by weight of a heated solvent, such as an aromatic petroleum hydrocarbon. When the solution cools it thickens slightly and can be applied without reheating. Examples of commercially available styrene-butadiene-block copolymers suitable for such use are Kraton 1101 and 1102 as produced by the Shell Chemical Company.

A polyamide polymer based adhesive can be produced by mixing 75 parts by weight of a polyamide, having a melt index range of 6 to 15 at 401° F. and which also must be soluble and remain a liquid solution at room temperature, with 25 parts by weight of a polyterpene resin. This is then dissolved in heated solvents comprising 200 parts by weight of an aromatic petroleum hydrocarbon, 60 parts by weight of an acetone free diacetone alcohol and 60 parts by weight of an isopropyl alcohol. The solvents are heated to about 150° F. to obtain a solution. The adhesive remains a homogenous liquid mixture when cooled to room temperature and can be applied anytime as such and heated to drive off the solvents. The adhesive can then be reactivated and the ends applied to the container bodies by heating the adhesive to about 400° F. Examplesof commercially available polyamides suitable for such use are Milvex 1000 and Milvex 4000 produced by General Mills Inc.

Rubber materials employable as sealants in double seams of this invention are, for example, organic solvent-soluble styrene-butadiene copolymer rubber materials. Suitable such materials and their methods of preparation are disclosed in U.S. Pat. No. 2,767,152 issued on Oct. 16, 1956. These copolymer rubber materials usually contain from 10 to 90 parts by weight styrene and 90 to 10 parts by weight butadiene, based on the weight of the copolymer. A commercially available styrene-butadiene rubber suitable for forming sealants for seams for beer and carbonated beverages is that manufactured by and sold by the B.F. Goodrich Chemical Company under their Registered U.S. Trademark Ameripol. The copolymer can be physically mixed with other rubbers for desired properties, for example with small amounts of a nonsoluble acrylonitrile, or butadiene-acyrlonitrile compolymer rubber to increase toughness. The rubber materials often comprise about equal parts of about 33 weight percent styrene-butadiene compolymer rubber, about 33 weight percent tackifying resin such as polyterpene, and about 35 weight percent of other materials such as fillers, pigments, etc., these weight percents being based on the total weight of the rubber sealant material.

A commercially available polyterpene resin suitable for beer and carbonated beverage container seams is that manufactured by The Newport Division of, and sold under the Registered U.S. Trademark "Nirez" owned by the Heyden Newport Chemical Company.

The rubber sealant materials are usually prepared by dissolving the tackifying resin within an organic solvent for example a naptha, hexane or heptane, and adding the filler to the solution until it is dispersed therein. The styrene-butadiene rubber, preferably in crumb form, is then added to the dispersion and the mixture is maintained at about 100° F while it is agitated for from about four to ten hours.

The resulting sealant material is soft and tacky and is applied in that condition by conventional methods to the undersurface of the end flange and to an adjacent portion of the end closure countersink wall. The end is seamed to the container with (or without) heat depending on the nature of the product packaged in the container, and on the type of solvent used in the sealant. For example, containers employing a sealant having a heptane solvent must be dried with heat to purify the sealant and to drive off the solvent.

A suitable filler material for sealants for beer and carbonated beverages container seams is Buca clay, a generic name for a hydrous aluminum silicate commercially available from various manufacturers such as Southern Clays Incorporated. The filler materials usually include commercially available oxides such as zinc oxide and titanium dioxide. These are used as coloring and reinforcing agents for the sealants. Also often included is a substantially asbestos-free anhydrous aluminum silicate such as that manufactured and sold as Mistron Talc by the Mistron Vapor Company.

Examples of rubber sealant materials suitable for seaming containers for packaging fatty or oily products, and having sufficient resistance to flow at the elevated processing temperatures required for such products are disclosed in U.S. Pat. No. 3,402,220 issued on Sept. 17, 1968. Disclosed therein are end compounds made from homogeneous mixtures of soft solvent-soluble rubbers and relatively hard solvent insoluble rubbers. The rubber lining compounds are prepared by intimately mixing with a heavy duty mixer, a soft elastomeric copolymer of isobutylene and a diolefin such as chlorobutyl rubber. This mixing is done in the presence of a curing agent such as zinc oxide for the chlorobutyl rubber, and while maintaining the temperature of the mixture below the curing temperature of the chlorobutyl rubber, advantageously below 260° F. Once complete blending is achieved, an acidic environment is provided by adding for example a stearic acid, and the temperature is raised to maintained preferably at about 330° F for about 15–60 minutes with or without mixing, until curing is complete and the resulting cured rubber base stock has a Mooney viscosity of from about 100 to 110. Then separately, zinc resinate is dissolved in hexane, and Buca clay and butyl rubber in crumb form combined with the cured rubber base stock, are added to the solution to obtain a mixed rubber sealant material comprising from about 80–95% by weight butyl rubber based on the weight of the material.

The method of this invention wherein a body curl is used instead of a conventional flange in forming a double seam to attach a container end closure to a very thin walled metallic container, can be employed with any containers whose body are so thin that they cannot readily and consistently be flanged without cracking in the marginal end portion or flange area. According to this invention a very thin-walled metallic container body is generally defined as one whose thickness is such that its marginal end portion forms cracks, and other irregularities when it is formed into a conventional flange of about 0.092 inch, the flange being of the type used in forming a conventional double seam. Body wall thicknesses which are considered too thin to flange vary depending on the type of metal of which the container is made, its grain direction, and the tooling and process for forming the flange. It has been found that though they can be curled without cracking, body walls of highly-worked containers whose metal has a substantially axial grain direction and whose thicknesses adjacent or at their marginal end portions are less than about 0.006 inch for body walls of three-piece containers, and less than about 0.0057 inch for body walls of two-piece containers, cannot be conventionally flanged without cracking.

The method of this invention which allows marginal end portions of drawn and ironed containers to be thinner than conventionally found, allows container body walls to be made of uniform thickness. Preferably, such aluminum drawn and ironed container body walls are as thin as or thinner than 0.0048 and steel containers about 0.0038 overall or uniform thickness.

This invention can be employed in relation to two or three piece can bodies provided that the side seams of three piece can bodies when double seamed of a thickness and are in condition that allows them to be double seamed according to the method of this invention to provide hermetic pressure resistant double seams.

It is thought that the invention from the foregoing attendant advantages will be understood from the foregoing description and it will be apparent that various changes may be made in the form, construction and arrangement of the parts of the articles and that changes may be made in the steps of the method described and their order of accomplishment without departing from the spirit and scope of the invention or sacrificing all of its material advantages, the form hereinbefore described being merely preferred embodiments thereof.

I claim:

1. A method of hermetically double seaming a flanged metallic container end closure to an open-ended metallic cylindrical container body whose body wall metal is highly worked, has a substantially axial grain direction and is less than about 0.0057 inch thick at its marginal open end portion, to form a container capable of withstanding internal pressures of up to about 90 psi developed at elevated temperatures of up to about 140° F., which comprises:

forming an annular body curl of the less than about 0.0057 inch thick marginal open end portion of the container body wall, said curl having an edge which points toward the container body wall, placing a flanged metallic end closure over the curled open end of the container body, applying a sealant material to a surface of at least one of the end closure and body wall for bonding said closure and said wall together, and, double seaming the end closure to the container body by bending the end closure flange downward and up under the body curl between it and the container body, in a first operation, to form an end closure skirt and cover hook, and by radially compressing the seam, in a second operation, to bend the body curl and conform it to substantially the shape of the end closure skirt and cover hook, so that the compressed closure skirt and cover hook are coextensive with said body curl and terminate in adjacent edge portions presented axially toward the open end portion of the container body wall, tightening and bonding the seam against the container body, hermetically to double seam the end closure to the container body.

2. The method of claim 1 wherein the container body is drawn and ironed aluminum and the body curl forming step provides the curl radius of from about 0.007 to about 0.035 inch.

3. The method of claim 1 wherein the container body is drawn and ironed steel and the body curl forming step provides the curl with a radius of from about 0.007 to about 0.035 inch.

4. The method of claim 1 wherein the first operation double seam width is from about 0.096 to 0.099 inch.

5. The method of claim 1 wherein the width of the second operation hermetic double seam is from about 0.067 to 0.069 inch.

6. In a method of forming a three-piece double seamed metallic cylindrical container capable of holding internal pressure of up to about 90 lbs. psi developed at elevated temperatures of up to about 140° F., and whose body wall metal is highly worked, has a substantially axial grain direction and is less than about 0.006 inch thick adjacent it marginal open end portion, the steps comprising:

providing an open-ended metallic cylindrical container body whose body wall is less than about 0.006 inch thick at a marginal open end portion, forming an annular body curl of a marginal open end portion so that the curl has an edge which points toward the container body wall, providing a metallic container end closure having merging panel portions including a central panel, an annular countersink wall portion peripheral to the central panel, and a peripheral flange, applying a sealant material to a surface of at least one of the closure flange and container body wall for bonding the flange and body wall open marginal end portion to each other, and hermetically double seaming the end closure to the curled marginal open end portion of the container body wall by bending the end closure flange downward and up under the body curl between it and the container body to form an end closure skirt and cover hook, and radially compressing the seam to bend the body curl, skirt and closure hook into a bonding configuration characterized by coextension of portions of said body curl and cover hook axially toward the recited end portion of the container body wall.

7. The method of claim 6 wherein the container body wall metal is steel and the body curl forming step is effected in a manner that the curl has a radius of from about 0.007 to about 0.035 inch.

* * * * *